US008307751B2

(12) United States Patent
Adolphsen

(10) Patent No.: US 8,307,751 B2
(45) Date of Patent: Nov. 13, 2012

(54) WEAPONS SYSTEM CONSTRUCTION AND MODIFICATION INCLUDING IMPROVED GAS MANAGEMENT SYSTEM

(75) Inventor: Alan Adolphsen, Hope, ME (US)

(73) Assignee: Teludyne Tech Industries, Inc., Greer, SC (US)

( * ) Notice: Subject to any disclaimer, the term of this patent is extended or adjusted under 35 U.S.C. 154(b) by 0 days.

(21) Appl. No.: 13/106,171

(22) Filed: May 12, 2011

(65) Prior Publication Data

US 2011/0277623 A1 Nov. 17, 2011

Related U.S. Application Data

(60) Provisional application No. 61/334,024, filed on May 12, 2010.

(51) Int. Cl.
*F41A 21/44* (2006.01)

(52) U.S. Cl. ..... 89/193; 89/14.05; 89/14.1; 42/90; 42/76.02

(58) Field of Classification Search ..... 89/14.05, 89/14.1, 193; 42/76.02, 90
See application file for complete search history.

(56) References Cited

U.S. PATENT DOCUMENTS 5,103,714 A * 4/1992 LaFrance ..... 89/129.01
2007/0033851 A1* 2/2007 Hochstrate et al. ..... 42/75.01

OTHER PUBLICATIONS

Jun. 26, 2008, "My Water Cooled Upper Project", from author Scott, username canon3825 on http://www.ar15.com/archive/topic.html?b=3&f=4&t=384217.*

* cited by examiner

*Primary Examiner* — Michael Carone
*Assistant Examiner* — John D Cooper
(74) *Attorney, Agent, or Firm* — McNair Law Firm, P.A.; Douglas W. Kim

(57) ABSTRACT

This invention is directed to a rifle barrel having a gas port for a gas operated weapon system comprising: a forward gas redirection tube operably associated to said rifle barrel so that expelled gas from a cartridge travels out of said gas port and into said forward gas redirection tube; a rear gas connector operably associated with said forward gas redirection tube for receiving expelled gas traveling in said forward gas redirection tube; a rear gas redirection tube removably connected to said rear gas connector for receiving expelled gas and transferring said gas to the action of the weapons system to assist with the cycling of the weapons system action; a sleeve arranged around said rifle barrel defining a void between said rifle barrel and said sleeve; and filler material carried in said void defined between said rifle barrel and said sleeve wherein said forward gas redirection tube is disposed within said filler material between said sleeve and said barrel.

34 Claims, 17 Drawing Sheets

WEAPONS SYSTEM CONSTRUCTION AND MODIFICATION INCLUDING IMPROVED GAS MANAGEMENT SYSTEM

CLAIM OF PRIORITY

This application claims priority on U.S. Patent Application Ser. No. 61/334,024, filed May 12, 2010 and U.S. patent application Ser. No. 12/774,402 which claims priority on U.S. Provisional Patent Applications 61/176,200, 61/230,450, and 61/287,785.

FIELD OF THE INVENTION

This invention is directed to a weapons system having a rifle, shotgun or cannon barrel and more particularly to a gas operated weapons system. This invention is directed to the construction of a rifle, shotgun or cannon barrel and method of modification providing a sandwich barrel design for reducing heat and harmonics and for improving accuracy. The improved gas management system is combined with the modified gun barrel of the present invention to reduce flex and harmonics while providing for adjustable gas return levels in the tube for improved accuracy and control.

BACKGROUND

It has been long understood that a rifle's barrel changes shape and moves in multiple directions every time the rifle is fired. This effect is also found in shotgun and cannon barrels. In some instances, this movement of the barrel has been coined "barrel whip" and is when a weighted object (bullet) travels down the tubular barrel under intense gas pressure generally defined as when the barrel away from its "static" state. Barrel whip can occur when the bullet accelerates into a rapid spin, when the stock drops significantly so the muzzle rises when the rifle is fired, or when a pressure wave travels the length of the barrel. In the case of shotguns and unrifled cannon barrels, the "barrel whip" largely results from the pressure wave traveling along the barrel.

Barrel whip reduces the accuracy of the projectile expelled from the barrel and, therefore, the ability of a shooter to hit a target. Historically, manufacturers of barrels have simply accepted that the barrel's movement can't be eliminated. The remedy was to manufacture the barrel so that at least the movement was consistent with each shot. With a combination of cartridge loads and a consistently moving barrel whip, a rifle can be made more accurate by matching the load with the barrel. However, this requires that cartridge loads be customized to match each individual barrel and requires a high degree of customization.

Further, with each shot, the chamber can swell and produce an annular wave that travels between the muzzle and the breech. As the annular wave travels down the barrel, the bore diameter changes slightly as a result of the wave. If the bullet exits the barrel coincidentally with the wave at the muzzle, the bullet accuracy is greatly reduced since the bore and the bullet will be ejected through a bore that is made larger due to the wave. Traditional attempts to avoid this problem have been to change the cartridge load so that the bullet does not exit the barrel when the annular wave is at the muzzle. Again, this involves a high degree of customization and requires that cartridge loads match each individual barrel.

Further, as rounds are shot through a barrel, the barrel heats and the metal expands, becomes more flexible, and, therefore, the effect of barrel whip and any annular waves increases. Some tests have found that the center of the bore can change as much as 0.001 inches between the barrel temperatures of 77° F. (ambient) and 122° F. While the number of rounds that it takes to heat a barrel from ambient to over 120° F. varies greatly with the type for round, the type of barrel and other factors, such temperature changes can occur in as little as four or five rounds. Therefore, for multiple shots, the heat generated by the shots can adversely affect the accuracy of the barrel. This effect is exemplified in FIG. 4.

An additional problem arises in weapon systems that utilize gas return mechanisms to capture escaping gas from the barrel and redirect the gas into the action to cycle the bolt for filing the next round. Typically, a rifle with a gas management system, such as an AR15/M4 platform which includes a gas exit port disposed along the length of the barrel, and in some cases, is part of the front sight assembly. A metal tube is connected to the port and runs back along the length of the barrel and into the action of the rifle. As a bullet is fired down the barrel, gas is forced into the tube and then into the action to help cycle the bolt to fire the next round. In current designs, however, the gas return tube is free floating along the length of the barrel and only secured at its distal ends. A problem arises in that when gas is forced into the tube, it can cause the tube to flex and create additional harmonics that interact with the barrel whip described above. Thus, an additional loss of accuracy is suffered in these weapon systems.

Accordingly, it is an object of the present invention to provide a weapons system that was manufactured or modified to reduce the effects of barrel whip, annular or pressure waves, and heat produced when firing.

It is a further object of the present invention to provide a weapons system that was manufactured or modified so that it would not be necessary to match cartridge loads with barrel characteristics so that barrel accuracy was not necessarily cartridge specific.

It is a further object of the present invention to provide a gas management system for a weapon system that reduces flex and harmonics associated with a gas return tube to improve accuracy while maintaining the benefits of a gas management system.

It is a further object of the present invention to provide a control mechanism to adjust the flow of gas return to the action.

SUMMARY OF THE INVENTION

The present invention is accomplished by providing a rifle barrel having a gas port for a gas operated weapon system comprising: a forward gas redirection tube operably associated to the rifle barrel so that expelled gas from a cartridge travels out of the gas port and into the forward gas redirection tube; a rear gas connector operably associated with the forward gas redirection tube for receiving expelled gas traveling in the forward gas redirection tube; a rear gas redirection tube removably connected to the rear gas connector for receiving expelled gas and transferring the gas to the action of the weapons system to assist with the cycling of the weapons system action.

A sleeve is arranged around the rifle barrel defining a void between the rifle barrel and the sleeve; filler material carried in the void defined between the rifle barrel and the sleeve wherein the forward gas redirection tube is disposed within the filler material between the sleeve and the barrel.

The invention can include a rear opening defined in the sleeve for receiving the rear gas connector wherein the rear gas connector it at least a portion of the rear gas connector is disposed between the rifle barrel and the sleeve, a forward gas connector connected to the rifle barrel so that expelled gas enter the forward rifle gas connector and the forward gas connector receives the forward gas redirection tube to redirect expelled gas toward the action of the weapon system, a lock pin for securing the rear gas redirection tube to the rear gas connector, and a control mechanism for regulating the amount of gas that can pass through the rear gas connector.

The invention can include grooves defined in the barrel for receiving filler material. An end cap can be carried by the sleeve and further defining the void disposed between the rifle barrel and the sleeve and for reducing expelled gas from the muzzle of the rifle barrel from entering the void. Threads can be carried by the end cap for securing accessories to the sleeve. The rear gas connector can be connected to the rifle barrel and/or to the sleeve.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits and advantages of the present invention will be apparent from the summary and certain embodiments described below, and will be readily apparent to those skilled in the art. Such objects, features, benefits and advantages will be apparent from the above in conjunction with the accompanying examples, data, figures and all reasonable inferences to be drawn there from, alone or with consideration of any references incorporated herein.

DETAILED DESCRIPTION OF THE INVENTION

Figure 1A:
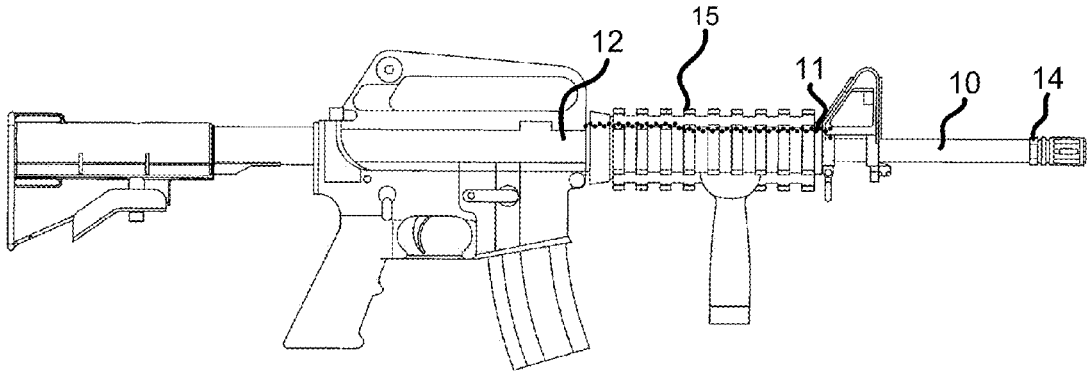
FIG. 1A is a side view of the prior art.
Figure 1B:
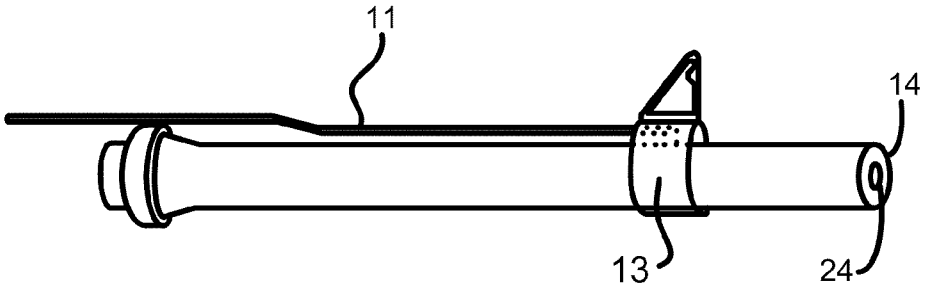
FIGS. 1B and 1C are perspective views of the prior art.
Figure 1C:
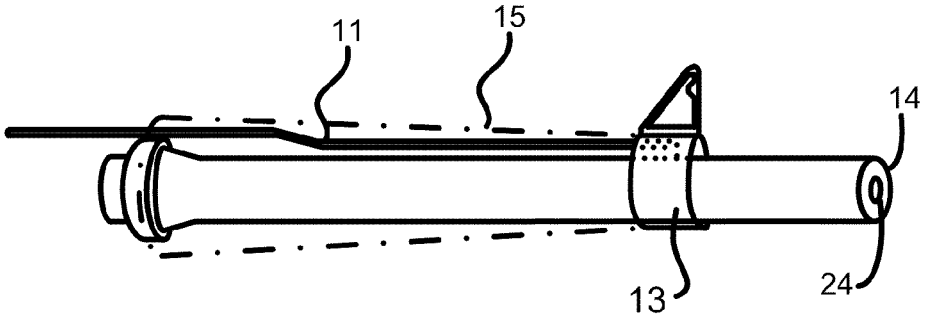

Referring to FIGS. 1A through 1F, a barrel 10 is shown attached to a gas operated reloading weapon. For example, the AR15, or M4 model rifle is a popular gas operated weapon system. Generally, such weapons systems include a barrel 10 having a receiver 12 and muzzle 14. Round 18*a* (FIG. 1E), which may be a shotgun shell containing multiple shot or a single slug projectile cartridge round, is received by barrel 10. Rounds can be either inserted individually into the breech or through a magazine configuration 20 for holding multiple rounds as is well known to those skilled in the art. In the magazine configuration, the rounds are biased in a direction such as shown by 22 so that when the action of the rifle or shotgun is cycled, rounds are inserted into the breech and can be filed. The barrel defines a bore 24 (FIG. 1B). The bore can be a smooth bore, such as in a shotgun or cannon, or contain rifling as is common in most rifles and smaller single projectile fire arms such as handguns.

In one embodiment, gas tube 11 is included in the gas operated weapon system. The gas tube receives gas that travels the barrel down the bore, out the gas port in and toward the action where it is expelled to assist the bolt to be pushed backward to cycle the next round in the magazine. Traditionally in a gas operated or gas assisted action utilize gas from the expended cartridge to assist the operation of and the complete cycling of the bolt. Gas block 13 (FIG. 1C) is placed around the barrel so that an opening defined in the gas block aligns with an opening in the barrel to allow escaping gas to enter the gas block. The gas tube is received by the opening in the gas block and allows the escaping gas to be directed rearward to the action. In one embodiment, the gas tube is contained within a hand guard 15 (FIG. 10). However, when the action cycles, force is exerted on the gas tube in a forward direction which is transferred to the barrel at the gas block location causing the barrel to move. The barrel which is farthest from the action is the most flexible so that the closer to the muzzle the gas block is located the greater the effect of the action cycle in flexing the barrel.

Figure 1D:
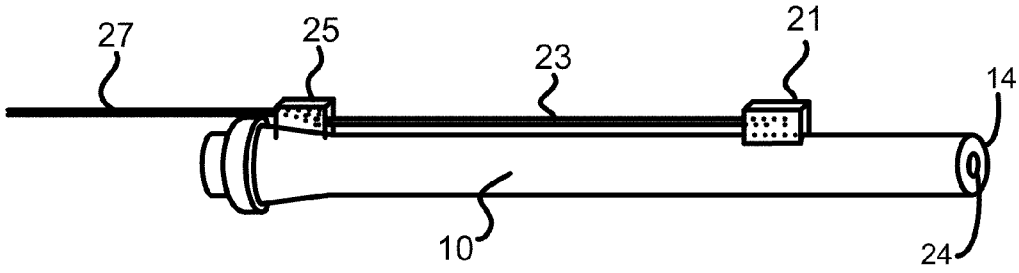
FIG. 1D is a perspective view of the invention.
Figure 1E:
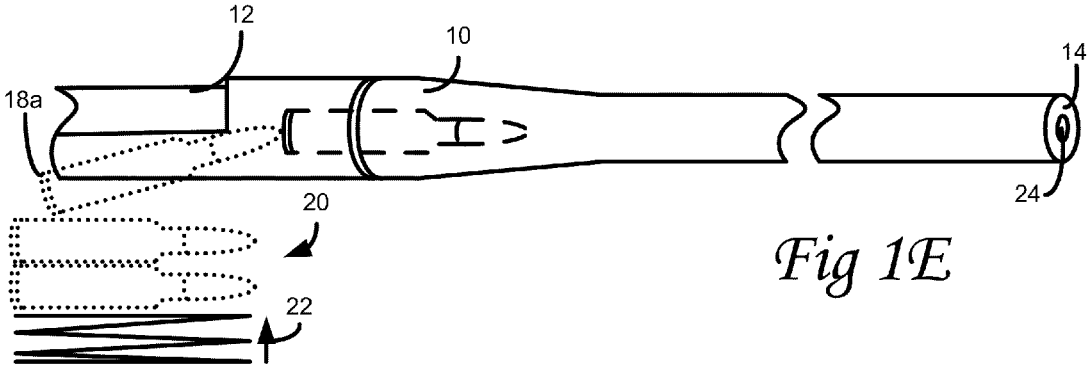
FIG. 1E is a perspective view of the prior art.
Figure 1F:
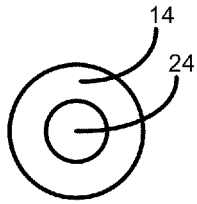
FIG. 1F is a muzzle view of the prior art.

Referring to FIG. 1D, the present invention includes a forward gas connector 21 having an opening defined in the forward gas connector which allows escaping gas to travel down a forward gas redirection tube 23 and into rear gas connector 25. The rear gas connector includes an opening defined in the rear gas connector for receiving gas redirection tube 23 in one end and receiving rear gas redirection tube 27 at the other end. The rear gas connector can include a second opening for receiving a locking pin. The rear gas redirection tube can include an opening in one end for receiving a locking pin so that when the rear gas redirection tube is received by the rear gas connector, the action gas redirection tube is secured to the rear gas connector. The forward and rear gas connectors can be welded or otherwise affixed to barrel 10. The forward gas connector, forward gas redirection tube and rear gas connector are cooperatively assembled to form a gas return assembly. The rear gas redirection tube can them be operatively connected to the gas return assembly when assembling or disassembling the weapons system.

Referring to FIG. 2A through FIG. 2E, a cartridge (or shotgun shell/round) 26 is shown having case 28 and bullet 30. In the case of a shotgun, bullet 30 may be a single projectile (slug) or a plurality of small projectiles commonly referred to as shot. The construction of shotgun shells is well known to those skilled in the art and thus not specifically illustrated. It should be understood by those of ordinary skill in the art that the present invention is applicable to any and all weapons systems utilizing a barrel to eject a projectile(s) regardless of the form of the round or number of projectiles contained in a single cartridge. Case 28 can contain gunpowder or other explosive that when ignited, expands and pushes the bullet through the bore. In the case where the bore contains rifling, the bullet is caused to rotate in a direction illustrated as 32 which causes the bullet to spin within and upon leaving the bore. When the bullet is pushed out the bore, torque is applied to the barrel and the barrel can experience barrel whip shown as 34. As previously explained, barrel whip adversely impacts the accuracy of the barrel as the bullet can leave the muzzle when the bore is "off target." It should be noted that the barrel whip can be in a linear direction or circular so that the barrel can whip in two or three dimensions.

Figure 2A:
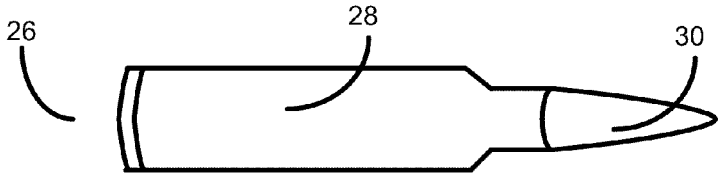
FIGS. 2A through 2F are schematics illustrating the need for the invention.
Figure 2B:
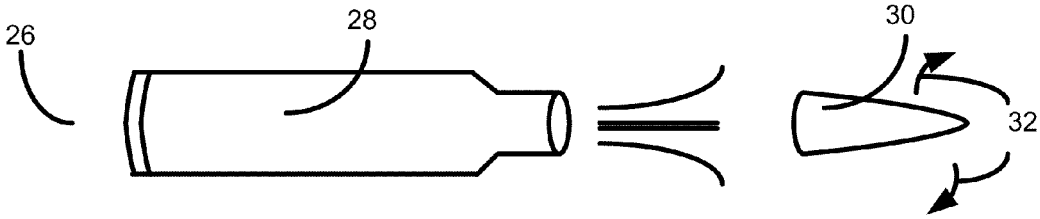
Figure 2C:
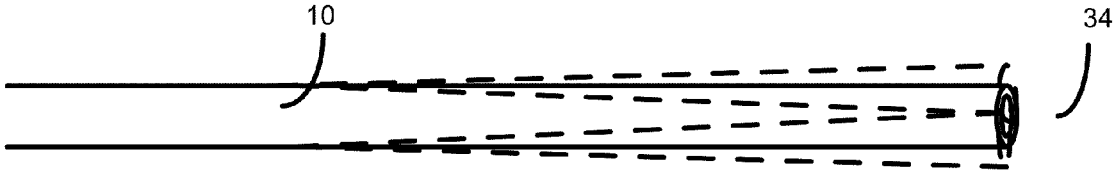
Figure 2D:
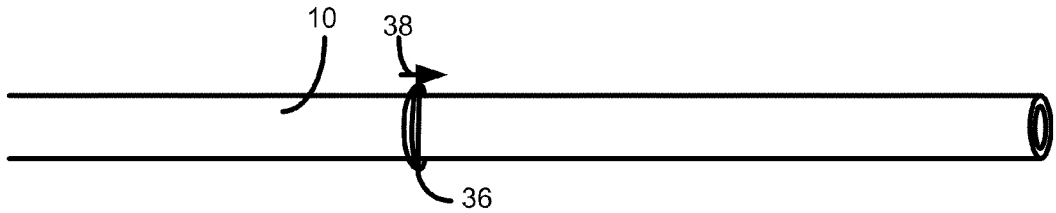
Figure 2E:
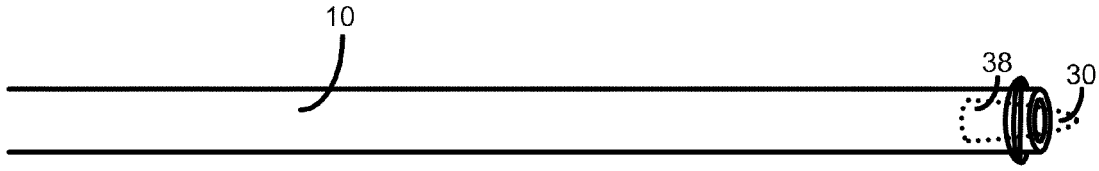

Referring to FIG. 2D, the expanding gas from the ignited explosive can create an annular wave 36 that initially travels in a direction 38 down the barrel and will rebound in a direction opposite 38 and "bounce" back and forth for some period of time along the barrel. When the annular wave reaches the muzzle, the muzzle of the barrel can "whip" so that the bore moves "off target". This effect is particularly undesirable when bullet 30 and annular wave 38 reach the muzzle approximately contemporaneously. The barrel whip effect is equally undesirable in smooth bore barrel weapons such as shotguns and cannons.

Figure 2F:
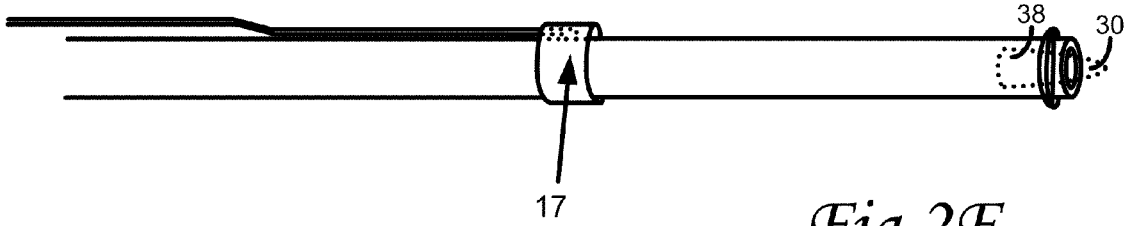
Figure 4:
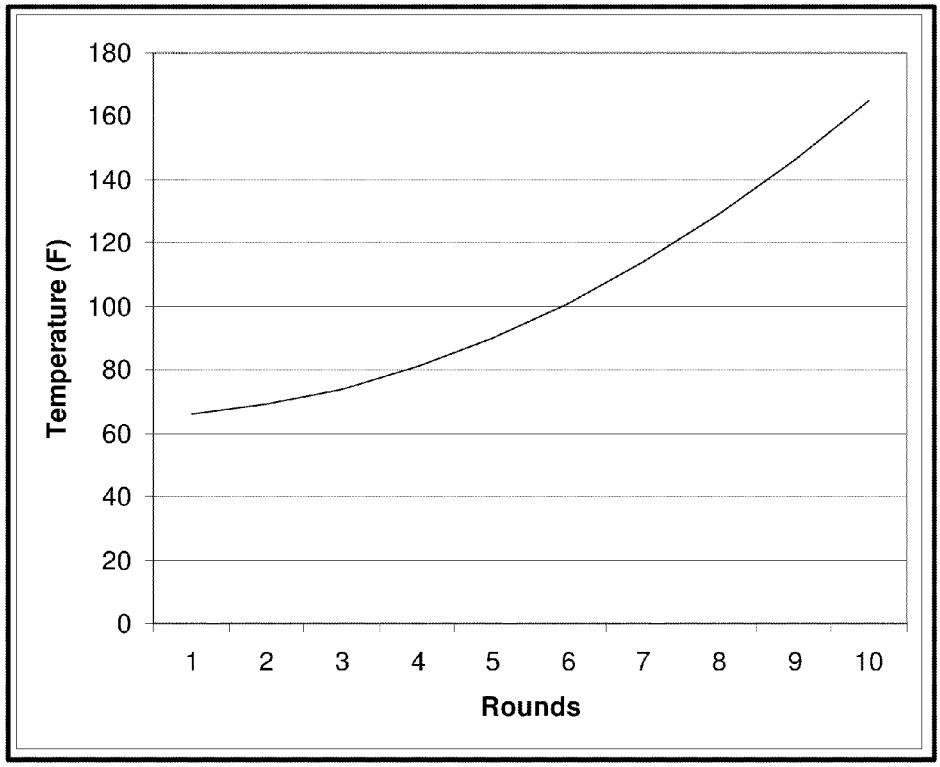
FIG. 4 is a chart illustrating heat building in a barrel.
Figure 5A:
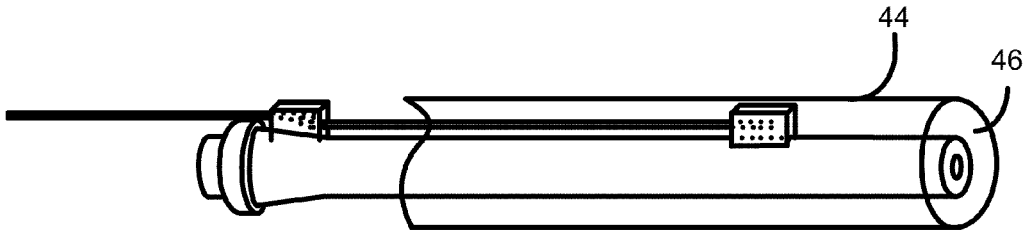
FIGS. 5A through 5C are schematics of the invention.
Figure 5B:
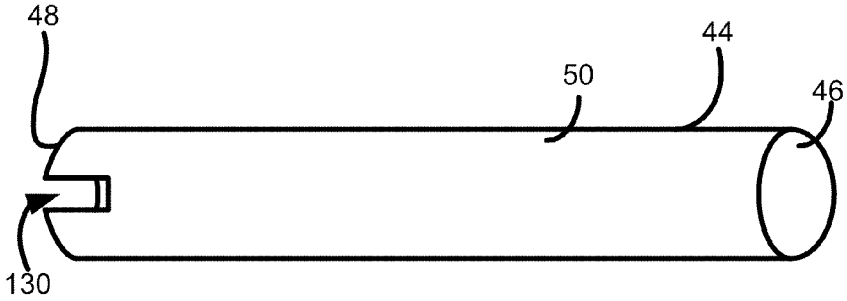
Figure 5C:
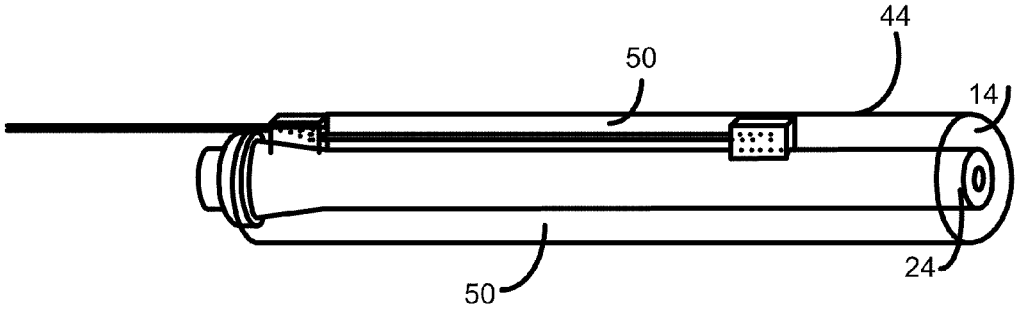
Figure 6A:
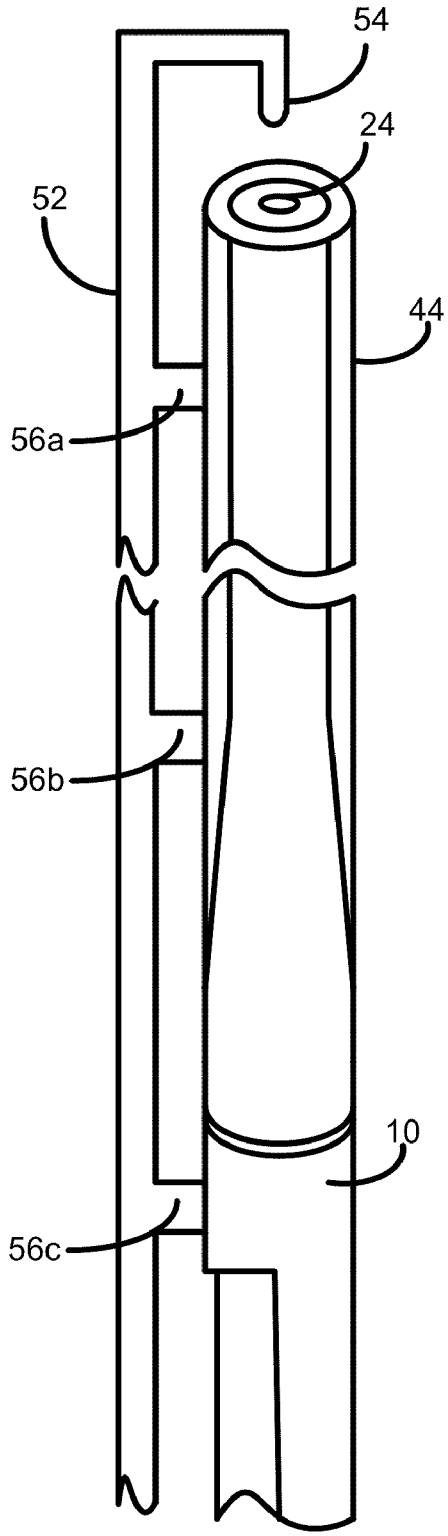
FIGS. 6A through 6E are schematics of the invention.
Figure 6B:
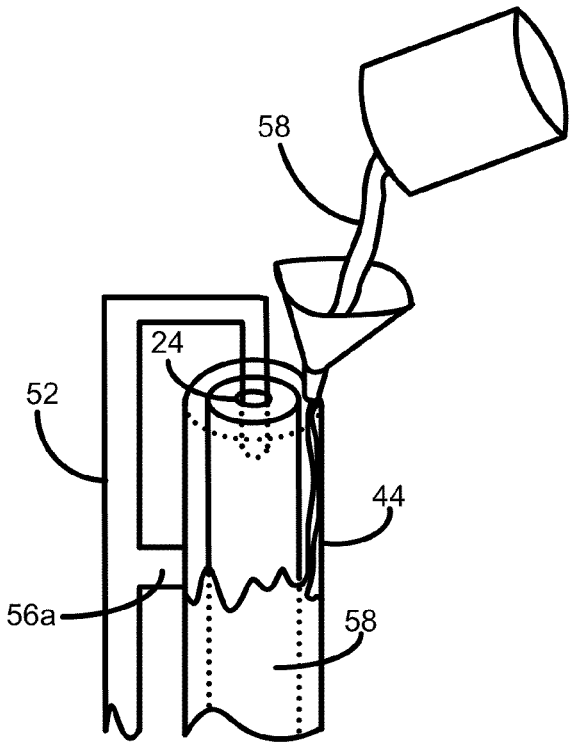
Figure 6C:
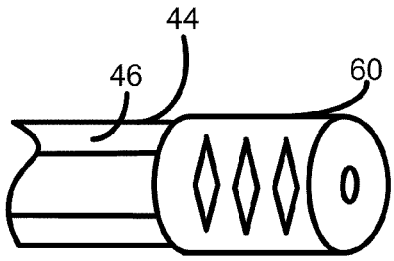
Figure 6D:
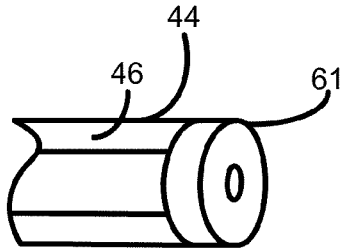
Figure 6E:
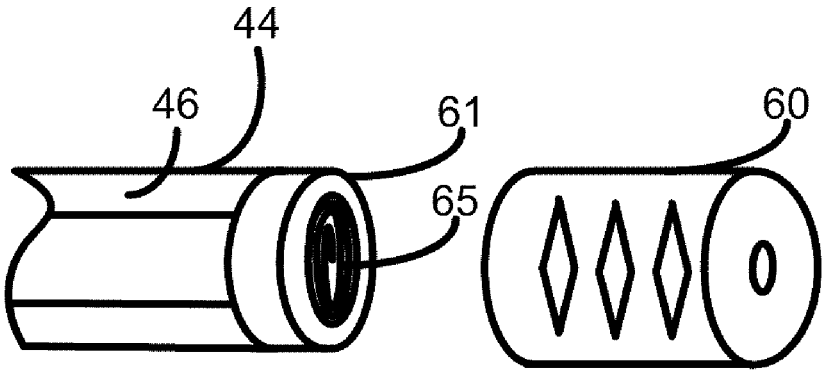

Referring to FIG. 2F, when the annular wave travels down a barrel containing a traditional gas block, the annular wave can further vibrate the barrel as the gas block is effected by the same. Further, the annular wave can be magnified if the forces exerted on the gas tube from the operation of the action are imparted to the barrel at point 17 due the physical contact and force being transferred from the gas tube to the gas block to the barrel. When multiple rounds are fired and the barrel temperature rises as shown in FIG. 4, the "barrel whip" is magnified.

Figure 3A:
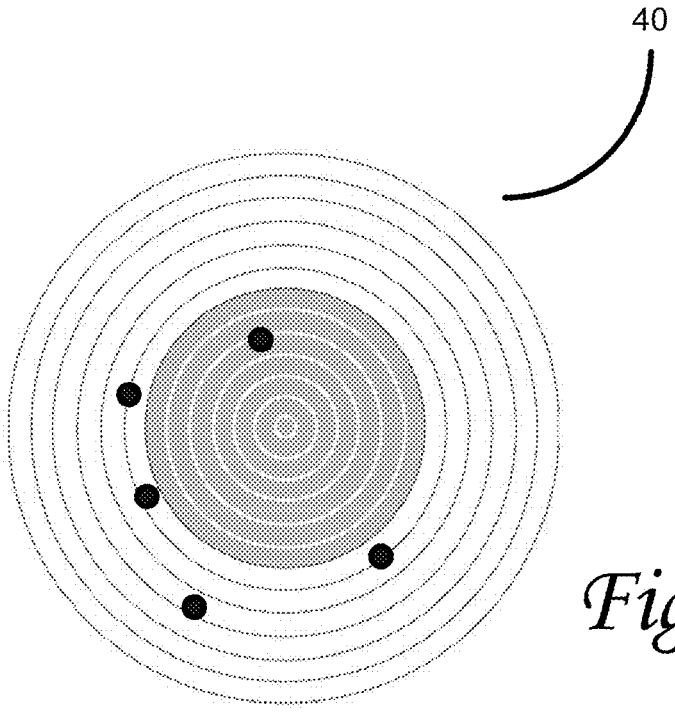
FIGS. 3A through 3B are schematics illustrating the need and results of the invention.
Figure 3B:
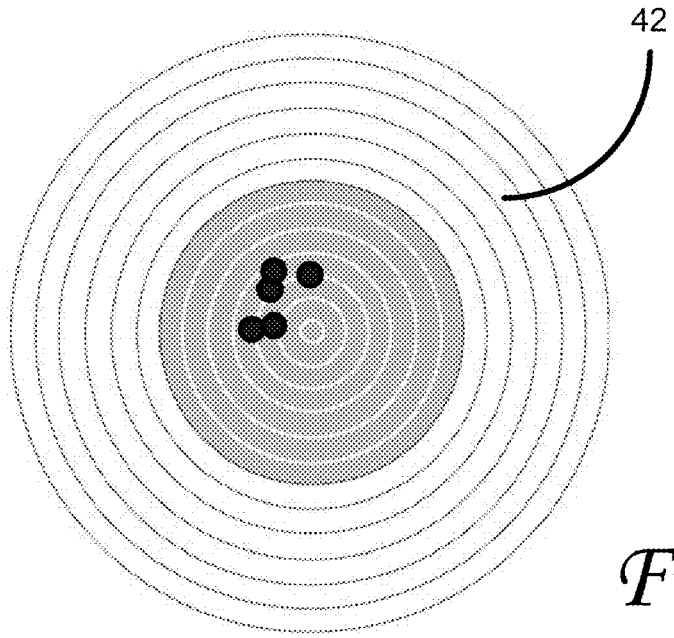

Given the multiple undesirable forces on the barrel, the accuracy of any rifle, shotgun or cannon is significantly compromised, particularly after multiple rounds are fired in relatively quick succession. Referring to FIGS. 3A and 3B, the results of a rifle barrel that has not been modified or manufactured with the present invention is illustrated as 40. Once the invention was applied to the above rifle barrels, the results are illustrated as 42 showing a significant improvement in accuracy.

Referring to FIGS. 5A through 5E, the invention's application and construction will be described in more detail. A sleeve 44 is placed over barrel 10 of a rifle with the forward gas connector, forward gas redirection tube and rear gas connector that are carried by the barrel. Sleeve 44 defines a muzzle sleeve opening 46 and a breech sleeve opening 48. In one embodiment, the breech opening is proximate to the barrel nut so that the sleeve approximately seals around the barrel and enclosing the forward gas connector, forward gas redirection tube and at least a portion of the rear gas connector. In one embodiment, the sleeve fits generally flush with the barrel nut and has a diameter less than the barrel nut.

Figure 10A:
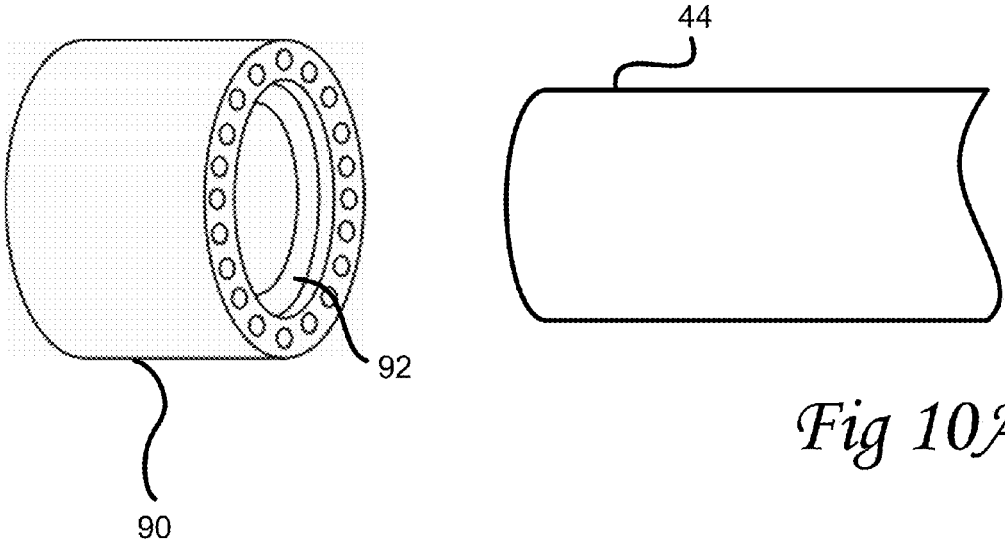
FIGS. 10A and 10B show a perspective view of aspects of the invention.
Figure 10B:
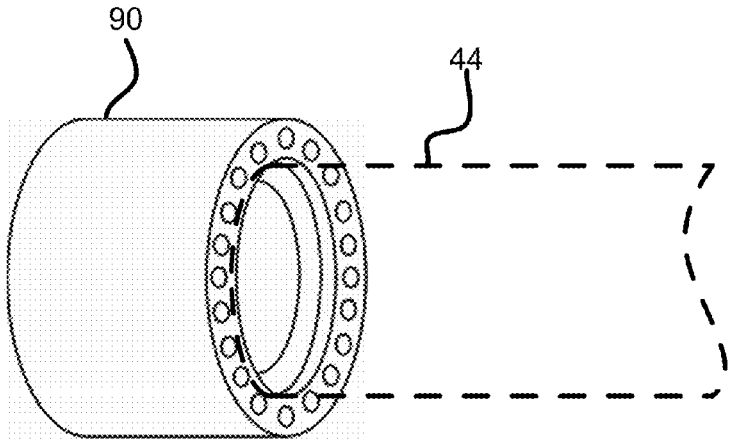

Referring to FIGS. 10A and 10B, a barrel nut 90 can be modified to includes a sleeve receiving area 92 having a inner diameter greater than that of an unmodified barrel nut. The receiving area then receives the sleeve so that at least a portion of the is disposed inside the barrel nut as shown in FIG. 10B.

The sleeve and the outer boundary of the barrel define a void 50. In one embodiment the sleeve is manufactured from stainless steel. The sleeve can also be manufactured from other metals, composite plastics, or a fibrous material sufficient to maintain its structure while being exposed to the heat and vibrations of a weapons system barrel. The sleeve can be generally circular or polygonic in shape.

In one embodiment, the sleeve is generally twice the diameter of the rifle, shotgun or cannon barrel. In one embodiment, the barrel is machined to reduce the diameter of the barrel prior to installing the sleeve. This allows for the use of a smaller diameter sleeve and can assist with replacement of the modified barrel back in the stock of the rifle or other component of the weapons system. It should be noted that the sleeve need not be circular in shape and can be any shape including hexagon, oval, square and such.

In some configurations, it may be necessary to apply a sealant such as epoxy or putty at the sleeve breech opening so as to generate a seal between the sleeve and the barrel. Once the sleeve is in place, the barrel and sleeve are placed in a vertical position, in one embodiment as shown in FIGS. 6A through 6F. A barrel centering member 52 is used to center the barrel in the sleeve. In one embodiment, the barrel centering member 52 contains a distal member 54 that is received in bore 24. Spacing members 56*a* through 56*c* carried by spacing member 52 positions the barrel generally parallel to the center axis of the sleeve wherein the center axis of the sleeve coincides with the center axis of the barrel. It should be noted that placement of the barrel in the sleeve need not be exact to achieve the benefits of this invention.

In one embodiment, a realignment tool 84 is used to align the barrel in the sleeve. In this embodiment, the muzzle end 86 is placed in the bore of the barrel. The end cap or weld-on threads are placed on the muzzle end generally at 88 so that when the alignment tool in placed in the bore, the end cap or weld-on threads can be aligned with the sleeve. A muzzle brake can be placed generally at 90 over the alignment tool and attached to the end cap so that weld-on threads, muzzle brake and alignment tool, carried within the muzzle brake and weld-on tool, so that when the alignment tool is inserted into the bore, the barrel can be aligned within the sleeve and the sleeve can be aligned with the weld-on tool and muzzle brake.

Once the sleeve is in place and the barrel is positioned with the sleeve, filler material 58 is placed in void 50 defined by the sleeve and the barrel. In the case of double barrel shotguns, the sleeve is constructed and arranged to enclose both barrels and the filler material 58 is then simultaneously placed in the void surrounding both barrels in the same manner as described above for a single barrel. In one embodiment, the filler material is a hydraulic type cement that when mixed with water will harden rapidly to produce a permanent bond. The filler material can be applied in a semi-fluid state and poured between the sleeve and the barrel.

In one embodiment the filler material is hydraulic cement comprising at least 50% calcium sulfate and 48% or less portland cement and may contain amorphous silica, alumina, limestone dust, clay, quartz, calcium hydroxide and calcium sulfo aluminate. In one embodiment the filler material is hydraulic cement comprising at least 90% calcium sulfate and 10% or less portland cement. The filler material can also be epoxy or resins that are able to withstand the heat generated from the firing of a barrel of a weapons system. In one embodiment, the filler material is mixed with metal shavings to enhance the filler materials ability to absorb and quickly dissipate heat from the barrel.

In one embodiment, a muzzle brake 60 can be installed after the sleeve and filler material have been installed. In one embodiment, a weld-on end cap 61 can be attached to the muzzle end of the sleeve. This weld-on end cap can be simply and end cap defining a center opening that is the same diameter of the bore of the barrel. The opening of the end cap can also be slightly larger than the barrel diameter. In one embodiment, the weld-on end cap has a threaded portion 65 that can receive a corresponding threaded portion (not shown) of a muzzle brake, or other attachment to attach the muzzle brake of other attachment to the threaded end cap allows for its attachment and removal without having to attach or remove the end cap.

Figure 7:
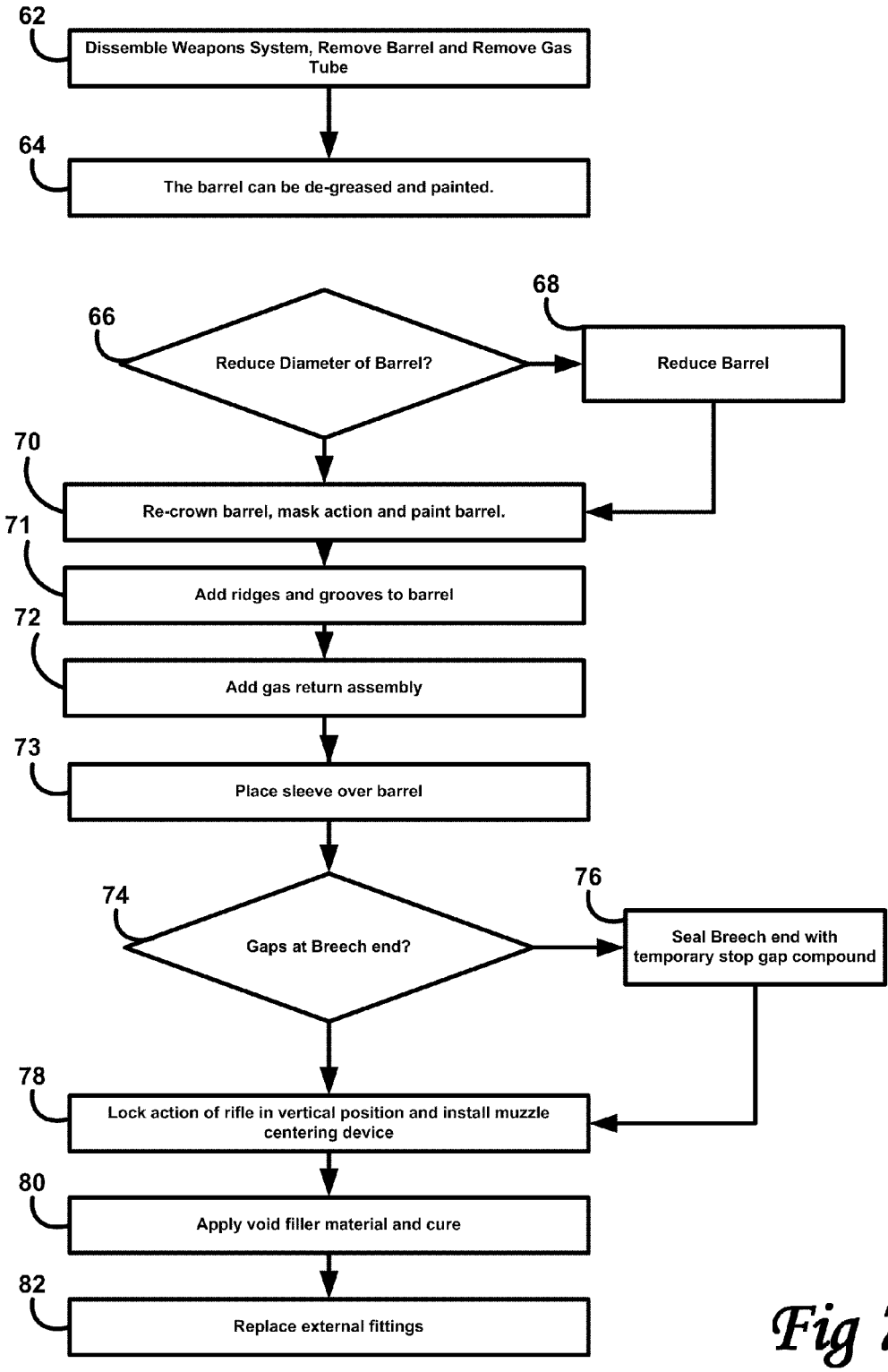
FIG. 7 is a flowchart illustrating the invention.
Figure 8:
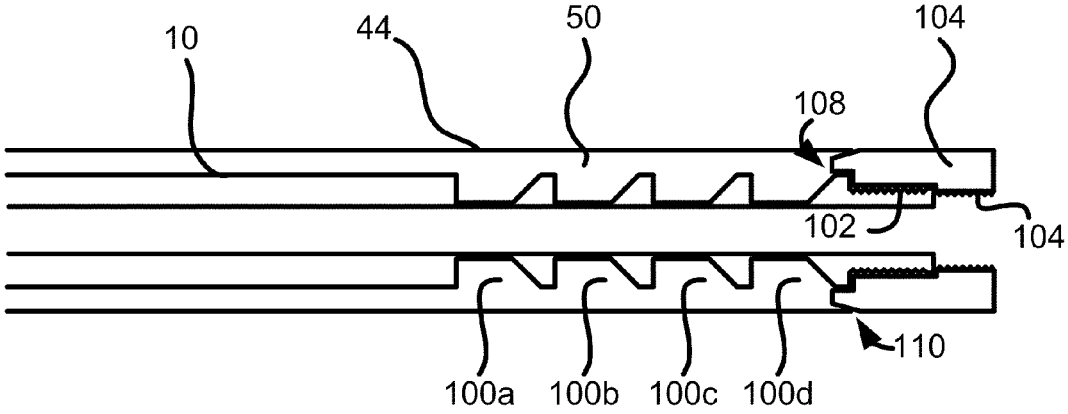
FIG. 8 is a schematic of the invention.

Referring to FIG. 7, the method of practicing this invention will be explained in more detail. The next steps is to dissambly the weapon system and remove of the barrel and gas tube at 62. The barrel can be de-greased and painted at 64. If the barrel diameter needs to be reduced at 66, the barrel is reduced at 68. In one embodiment, the barrel exterior surface is roughed to promote a more cohesive bond between the filer material and the barrel. Such roughing can be accomplished through the use of abrasive mean such as sandpaper. The barrel can be re-crowned at 70. The barrel can also be painted at 70. In one embodiment, circumferential grooves, such shown in FIG. 8 are cut into the barrel to provide larger void between the sleeve and the barrel for receiving filler material at 71. The gas return assembly is installed at 72.

The sleeve is measured and cut to the appropriate length based upon the barrel being modified. In one embodiment, the action end of the sleeve is beveled and squared so that it fits square against the action end of the barrel. A sleeve is placed over the barrel at 73. In one embodiment, the sleeve is pressed against the barrel using a press. If there is a gap between the sleeve breech opening and the barrel as determined at 74, the gap should be closed at 76. The action of the weapons system is locked and the muzzle centering device is installed at 78. The bore of the barrel is plugged and filler material is placed in the void defined by the barrel and the sleeve at 80 and the filler material is allowed to cure. In one embodiment, the twelve inches or so at the muzzle end of the sleeve is heated prior the filler material curing. The external fittings are replaced at 82 which can include tightening the muzzle brake to insure proper clocking (alignment), welding on the end cap, weld-on threads or muzzle brake. In one embodiment, clamps are used to secure the end cap, weld-on threads, or muzzle brake to the sleeve to assist with proper attachment when welding. The sleeve and some of the exposed portion of the barrel can be finished through painting, polishing, etc. The end cap, weld-on threads or muzzle brake, if used, have the center opening drilled to insure that there is no grazing when a bullet leaves the muzzle of the rifle barrel. The sleeve can be marked for maximum caliber and the muzzle brake can be marked for the specific chambering of the rifle.

Referring to FIG. 8, a cross-section of the invention is shown. Barrel 10 can be milled or otherwise modified to include one or more grooves shown as 100*a* through 100*d*. These grooves, when included, define void 50. When the filler material is placed in void 50, the filler material is received by the grooves and results in the filler material more securely affixing to the barrel.

In one embodiment, the barrel includes original threads 102 which can be used to attach muzzle brake, suppresser or other accessory to the original barrel of the weapons system. When the barrel is received by sleeve 44, the original thread can be complete covered by the sleeve or can protrude from the muzzle end of the sleeve. An end cap 104 can be attached to the sleeve to further define void 50. The end cap can include end cap threats 106 for attaching a muzzle brake, suppers or other accessory. The end cap can cover the void at the muzzle end shown at 108 to prevent muzzle gases from entering the void area and interfering with or otherwise effecting the filler material. The end cap can be permanently affixed to the sleeve through welding or the like at point 110.

In one embodiment, the barrel can be milled down to reduce its diameter thereby reducing the overall weight of the weapons system. The combination of filler material and sleeve are sufficient to reinforce the barrel following removal of excess diameter material.

Figure 9A:
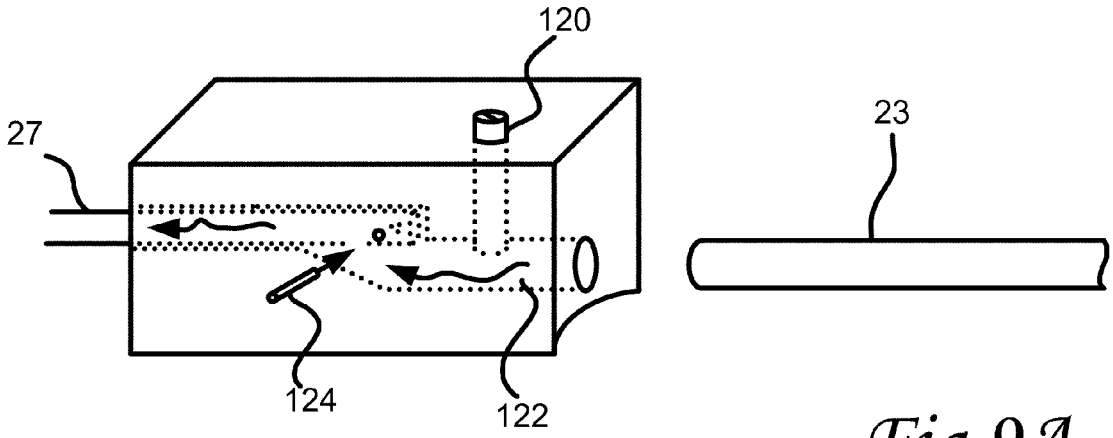
FIGS. 9A through 9B illustrate aspects of the invention.

In one embodiment, a control mechanism, designated generally as 120 (FIG. 9A), is provided in rear gas connector for adjusting the flow of gas through interior channel 122. In the illustrated embodiment, when control mechanism is lowered on the interior channel, less gas is allowed to pass through to the action of the weapons system. In one embodiment, the control mechanism may be a screw threaded into rear gas connector so that rotation of the screw causes it to extend into or retract from interior channel to adjust the flow of gas there through.

Once sleeve 44 and the filler material are applied to barrel 10, in order to disconnect the barrel from the rest of the weapon system, rear gas redirection tube disconnects from the rear gas connector. In order to prevent accidental disconnect between the rear gas redirection tube and rear gas connector, a lock pin 124 can be provided which extends through rear gas connector and engages rear gas redirection tube so that it cannot be removed from rear gas connector accidentally. Retracting the lock pin allows the rear gas redirection tube to be withdrawn from the rear gas connector.

Figure 9B:
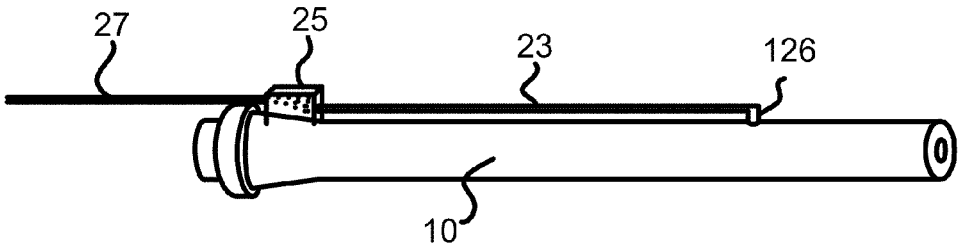

In one embodiment, forward gas redirection tube 23 includes an angled portion 126 (FIG. 9B) that is attached to the opening defined in the barrel for receiving expelled gas. This configuration removes the forward gas connector. When the forward gas redirection tube is received by the sleeve and surrounded by filler material, the forward gas redirection tube maintains sufficient structural integrity for operation of the weapons system.

Sleeve 44 can include a notch 130 (FIG. 5B) for receiving the rear gas connector when the sleeve is fitted over barrel 10. The rear gas connector then extends above sleeve 44 when mounted to barrel 10 for access to the lock pin and the control mechanism. Once the filler material is added, forward gas redirection tube is secured between sleeve 44 and barrel 10 to resist flexing and harmonic effect as gas is passed through the gas tubes. The forces applied to the rear redirection gas tube effect the rear gas connector near the chamber of the barrel thereby reducing the effects of the forces of the action cycling. Accordingly, the present invention also eliminates the free floating gas return tube to further improve accuracy on rifles with gas management systems that return gas to the action to help cycle the bolt.

While a preferred embodiment of the invention has been described using specific terms, such description is for illustrative purposes only, and it is to be understood that changes and variations may be made without departing from the spirit or scope of the following claims.

What is claimed is:

1. A rifle barrel having a gas port for a gas operated weapon system comprising:

a forward gas redirection tube operably associated to said rifle barrel so that expelled gas from a cartridge travels out of said gas port and into said forward gas redirection tube;

a rear gas connector operably associated with said forward gas redirection tube for receiving expelled gas traveling in said forward gas redirection tube;

a rear gas redirection tube removably connected to said rear gas connector for receiving expelled gas and transferring said gas to the action of the weapons system to assist with the cycling of the weapons system action;

a sleeve arranged around the rifle barrel defining a void between the rifle barrel and said sleeve surrounding said rifle barrel;

filler material carried in said void defined between said rifle barrel and said sleeve wherein said forward gas redirection tube is disposed within said filler material between said sleeve and said barrel and said filler material surrounds said barrel; and, said filler material includes material taken from the group consisting of: hydraulic cement, at least 50% by weight of calcium sulfate, 48% of less by weight of portland cement, epoxy, resin and metal shavings.

2. The rifle barrel of claim 1 including a rear opening defined in said sleeve for receiving said rear gas connector wherein at least a portion of said rear gas connector is disposed between said rifle barrel and said sleeve.

3. The rifle barrel of claim 1 including a forward gas connector connected to said rifle barrel so that expelled gas enters said forward rifle gas connector and said forward gas connector receives said forward gas redirection tube to redirect expelled gas toward the action of the weapon system.

4. The rifle barrel of claim 1 including a lock pin for securing said rear gas redirection tube to said rear gas connector.

5. The rifle barrel of claim 1 including a control mechanism for regulating the amount of gas that can pass through said rear gas connector.

6. The rifle barrel of claim 1 including grooves defined in said rifle barrel for receiving filler material.

7. The rifle barrel of claim 1 including an end cap carried by said sleeve and further defining said void disposed between said rifle barrel and said sleeve and for reducing expelled gas from the muzzle of the rifle barrel from entering said void.

8. The rifle barrel of claim 7 including threads carried by said end cap for securing accessories to said sleeve.

9. The rifle barrel of claim 1 wherein said rear gas connector is connected to said rifle barrel.

10. The rifle barrel of claim 1 wherein said rear gas connector is connected to said sleeve.

11. The rifle barrel of claim 1 wherein said forward gas redirection tube is connected to said rifle barrel.

12. The rifle barrel of claim 1 wherein said rear gas connector includes a non-linear interior gas travel path.

13. A rifle barrel having a gas port for a gas operated weapon system comprising:

a forward gas redirection tube operably associated with said rifle barrel so that expelled gas from a cartridge travels out of the gas port and into said forward gas redirection tube;

a rear gas connector operably associated with said forward gas redirection tube for receiving expelled gas traveling in said forward gas redirection tube;

a rear gas redirection tube removably connected to said rear gas connector for receiving expelled gas and transferring said gas to the action of the weapon system to assist with the cycling of the weapon system;

a sleeve disposed around the rifle barrel defining a void between the rifle barrel and said sleeve covering said forward gas redirection tube; and, filler material disposed in said void and completely surrounding said rifle barrel and said forward gas redirection tube wherein said filler material includes material taken from the group consisting of: hydraulic cement, at least 50% by weight of calcium sulfate, 48% of less by weight of portland cement, epoxy, resin and metal shavings.

14. The rifle barrel of claim 13 including a rear opening defined in said sleeve for receiving said rear gas connector wherein at least a portion of said rear gas connector is disposed between said rifle barrel and said sleeve.

15. The rifle barrel of claim 13 including a forward gas connector connected to said rifle barrel so that expelled gas enter said forward gas connector and said forward gas connector receives said forward gas redirection tube to redirect expelled gas toward the action of the weapon system.

16. The rifle barrel of claim 13 including a control mechanism for regulating the amount of gas that can pass through said rear gas connector.

17. The rifle barrel of claim 13 including a plurality of grooves disposed near at the muzzle end having a forward angled plane and a read vertical plane defined in said rifle barrel for receiving filler material.

18. The rifle barrel of claim 13 including an end cap carried by said sleeve and further defining said void disposed between said rifle barrel and said sleeve and for reducing expelled gas from the muzzle of the rifle barrel from entering said void.

19. A rifle barrel having a gas port for a gas operated weapon system comprising:

a gas return assemble having a forward gas redirection tube, a rear gas connector operably associated with said forward gas redirection tube for receiving expelled gas from said gas port and directing said expelled gas to a rear gas redirection tube;

a sleeve surrounding said rifle barrel and enclosing said forward gas redirection tube; and, a void defined by said rifle barrel and said sleeve containing filler material wherein said filler material complete surrounds said rifle barrel and said filler material includes material taken from the group consisting of: hydraulic cement, at least 50% by weight of calcium sulfate, 48% of less by weight of portland cement, epoxy, resin and metal shavings.

20. The rifle barrel of claim 19 including a rear gas redirection tube received by said gas return assembly.

21. The rifle barrel of claim 19 wherein said filler material fills at least 60% of said void.

22. The rifle barrel of claim 19 including a rear opening defined in said sleeve for receiving said rear gas connector wherein at least a portion of said rear gas connector is disposed between said rifle barrel and said sleeve.

23. The rifle barrel of claim 19 including a forward gas connector connected to said rifle barrel so that expelled gas enter said forward rifle gas connector and said forward gas connector receives said forward gas redirection tube to redirect expelled gas toward the action of the weapon system.

24. The rifle barrel of claim 19 including a control mechanism for regulating the amount of gas that can pass through said rear gas connector.

25. The rifle barrel of claim 19 including troughs defined in said rifle barrel for receiving filler material.

26. The rifle barrel of claim 19 including an end cap carried by said sleeve and further defining said void disposed between said rifle barrel and said sleeve and for reducing expelled gas from the muzzle of the rifle barrel from entering said void.

27. A method for improving a rifle barrel having a gas port for a gas operated weapon system comprising:

providing a gas return assembly having a rear gas connector and a forward gas redirection tube;

affixing said gas return assembly to the rifle barrel so that gas expelled by a cartridge exits the gas port and enters the gas assembly to be redirected to the action of the weapon system to assist with the cycling of the weapons system action;

placing a sleeve on said rifle barrel arranged around said rifle barrel to define a void between said rifle barrel and said sleeve; and, placing filler material in said void so that said forward gas redirection tube is disposed within said filler material between said sleeve and said barrel and said filler material completely surrounds said rifle barrel wherein said filler material includes material taken from the group consisting of: hydraulic cement, at least 50% by weight of calcium sulfate, 48% of less by weight of portland cement, epoxy, resin and metal shavings.

28. The method of claim 27 including connecting a forward gas connector to said rifle barrel so that expelled gas enters said forward rifle gas connector from said gas port.

29. The method of claim 27 including securing a rear gas redirection tube to said rear gas connector with a lock pin.

30. The method of claim 27 including providing a control mechanism for regulating the amount of gas that can pass through said rear gas connector.

31. The method of claim 27 including creating groves in rifle barrel for receiving filler material.

32. The method of claim 27 including attaching an end cap to said sleeve to further define said void disposed between said rifle barrel and said sleeve.

33. The method of claim 27 including modifying a barrel nut to include a receiving area for receiving said sleeve.

34. The method of claim 27 wherein placing filler material in said void includes placing said filler material in a least 60% of the volume of said void.

* * * * *